United States Patent [19]

Moore

[11] Patent Number: 4,840,594

[45] Date of Patent: Jun. 20, 1989

[54] METHOD FOR MANUFACTURING ELECTRODES FOR A SPARK PLUG

[75] Inventor: David J. Moore, Fostoria, Ohio

[73] Assignee: Allied-Signal Inc., Morristown, N.J.

[21] Appl. No.: 202,285

[22] Filed: Jun. 6, 1988

[51] Int. Cl.[4] ..... H01T 21/02

[52] U.S. Cl. ..... 445/7; 313/141

[58] Field of Search ..... 445/7; 313/141, 142

[56] References Cited

U.S. PATENT DOCUMENTS 3,868,530 2/1975 Eaton et al. ..... 445/7 X
4,393,324 7/1983 Nishio et al. ..... 445/7 X
4,488,081 12/1984 Kondo et al. ..... 313/142 X
4,684,352 8/1987 Clark et al. ..... 445/7

*Primary Examiner*—Kenneth J. Ramsey
*Attorney, Agent, or Firm*—Leo H. McCormick, Jr.; Ken C. Decker

[57] ABSTRACT

A method of manufacturing for a spark plug (82) having a center electrode (80) and a side wire electrode (62) with a sphere of platinum (34, 68) mechanically retained in a cylindrical hole (34, 66) by an annular rib (40, 70) formed by a staking operation. Thereafter a force is applied that flattens the sphere (34, 66) to produce a disc (48, 72) which substantially covers the annular rib (40, 70) from exposure to the corrosive effects of gases in a combustion chamber.

7 Claims, 2 Drawing Sheets

METHOD FOR MANUFACTURING ELECTRODES FOR A SPARK PLUG

The invention relates to a method of making electrodes for a spark plug.

Spark plugs are used in internal combustion engines to ignite the fuel in the combustion chamber. Hence, the electrodes of a spark plug are subject to intense heat and an extremely corrosive atmosphere. To provide some degree of longevity for the spark plug, the side wire and center electrodes are made from a good heat conducting material such as copper surrounded by a jacket of a corrosion resistant material such as nickel.

The manufacture of copper and nickel electrodes for spark plugs has been accomplished in a variety of ways. For instance, U.S. Pat. No. 3,803,892 issued Apr. 16, 1974 and entitled "Method of Producing Spark Plug Center Electrode" describes a method of extruding copper and nickel electrodes from a flat plate of the two materials. U.S. Pat. No. 2,261,436 issued Nov. 4, 1941 and entitled "Spark Plug and Method of Making the Same" illustrates how copper and nickel is swaged into a single long wire and then cut to smaller lengths for use as electrodes in a spark plug. U.S. Pat. No. 3,548,472 issued Dec. 22, 1970 and entitled "Ignition Plug and Method for Manufacturing a Center Electrode for the Same" illustrates a method of cold forming an outer nickel cup shaped sleeve by several steps and then inserting a piece of copper wire into the cup and then lightly pressing the two materials together.

U.S. Pat. No. 3,857,145 issued Dec. 31, 1974 and entitled "Method of Producing Spark Plug Center Electrode" discloses a process whereby a copper center is inserted into a nickel member and attached thereto by a collar portion to assure that an electrical flow path is produced.

The spark plug electrodes produced by the methods disclosed above performed in a satisfactory manner when used in vehicles that were manufactured prior to the implementation of the clean air act of 1977 in the United States. After 1977, with modifications to engines and fuel, the operating temperature of most vehicles increased. As a result of the changes in the engines and fuel, some of the operating components in engines have been subjected to the corrosive effects of exhaust gases. For instance, in distributorless ignition systems, every other spark plug fires in reverse polarity. This causes gap erosion from both the center and side electrodes, depending on whether the spark plug is required to fire in normal or reverse polarity. Erosion of the center electrode is noticed if the spark plug is firing in normal polarity and, vice versa. Erosion is noticed on the side electrode if the spark plug is firing in reverse polarity. Thus, even though nickel center wire and side wire electrodes for spark plugs are resistant to most oxides, after a period of time of operating at combustive temperatures and exposive to combustive and recirculation gases corrosion and erosion occurs. Once corrosion and erosion has taken place, the electrical flow path deteriorates which can result in lower fuel efficiency.

U.S. Pat. No. 4,705,486 discloses methods of manufacturing an electrode wherein a platinum disc is welded to the tip of an inconel center wire. Thereafter, the center wire is placed in a die and extruded to a final desired length such that the platinum covers the weld to prevent deterioration of the electrical flow path between the center wire and platinum disc during normal operation when used in a spark plug.

In an effort to reduce the manufacturing cost of an electrode, U.S. Pat. No. 4,725,254 discloses a method of manufacture whereby an inconel center wire with a copper core are extruded to a desired length. A platinum ribbon is rolled to a desired thickness and disc punched therefrom. The disc has a cup shape with a peripheral flange. The disc and center wire are placed in a fixture and moved toward each other such that the disc surrounds the tip. When electrical current is passed from the tip of the inconel center wire to the platinum disc an arc occurs which results in the generation of thermal energy. The flow of current continues until the thermal energy is sufficient to melt the inconel at the junction between the tip and disc. Thereafter the electrical current is terminated. A compressive force which is maintained on the disc causes the inconel tip to fuse with the end cap and form a metallurgical bond or joint to complete the manufacture of the electrode.

The methods of manufacturing a center electrode with a platinum cap are satisfactory and meet current operational requirement for vehicles. Unfortunately, the cost of platinum has resulted in the cap costing as much or more than the other components in a spark plug.

In an effort to reduce the cost of the platinum for the electrodes a method has been devised whereby a sphere of platinum is retained in a cylindrical hole in the electrode by an annular lip formed by staking rather than through a weld operation as disclosed in copending U.S. application No. 202,284 filed concurrently herewith. The sphere of platinum can be accurately controlled and does not need to be aligned in the hole. After the staking operation, a force is applied to flatten a portion of the sphere extending from the hole to provide a cover for the annular rib.

Since the platinum spheres are not effected by combustive gases, after the linear distance between the flattened surface on the platinum spheres on the side wire and center electrode is fixed, the spark plug should operate in an acceptable manner for substantially the life of a vehicle.

An advantage in this method of manufacturing electrodes is the shape of platinum member can accurately be controlled such that a minimum size can be selected to offer protection for an inconel wire without a substantial increase in the cost over conventional spark plugs.

It is an object of this invention to provide a method of manufacturing a spark plug having center and side electrodes with a platinum sphere staked in a cylindrical hole therein such that the linear gap therebetween is not effected by exposure to combustion gases.

A further object of this invention is to provide a method of manufacturing an electrode whereby a platinum sphere is retained in a cylindrical opening by an annular lip and a portion of the sphere is flattened to define a protective surface which exceeding the diameter of the hole to establish an electrical conductive flow path that would be substantially uneffected by erosion of the electrode caused by the corrosive gases generated in an engine.

These objects and others should be obvious from reading this specification and viewing the drawing wherein.

Figure 1:
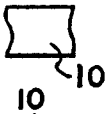
FIG. 1 is a cylindrical blank cut from a source of inconel wire.

The method of manufacturing an electrode for a spark plug is illustrated by the various steps set forth in the drawings of which FIG. 1 illustrates a piece of corrosion resistant metal wire having a dimension of about 0.139×0.2" which is cut from a spool or rod. The preferred metal wire is a corrosion resistant alloy of iron containing nickel and chromium generally known as inconel. One such inconel metal is known as Hoskins Alloy 831 and contains 75% nickel, 15% chromium and 7% iron.

Before placing a piece of inconel wire 10 into a die it should be coated with a standard cold heading lubricant. Such a lubricant is an oil with extreme pressure additives; sulphur, chlorine and neutral animal fat. It is most often a combination of sulphurized fat and a chlorine additive and is available from a good number of lubricant manufacturers. Lubrication is vital in cold heading to reduce die wear, promote good finishes and eliminate galling, scratching and seizing of the work piece by preventing pickups by the dye. During the cold heading operation, the sulphur and chlorine components of the lubricant form ferrous sulphides and chlorides which prevent welding of the die to the work piece and act in the same way as a solid lubricant. An example of one such lubricating oil is TUF-DRAW 21334 made by the Franklin Oil Corporation of Ohio.

Figure 2:
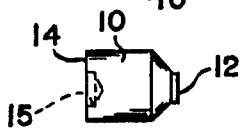
FIG. 2 is a view of the cylindrical blank of FIG. 1 which has been extruded to define a tip on a first end, an indentation on a second end.
Figure 3:
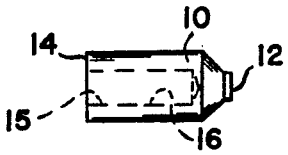
FIG. 3 is a view of the blank of FIG. 2 wherein the indentation has been elongated by a further extrusion step.
Figure 4:
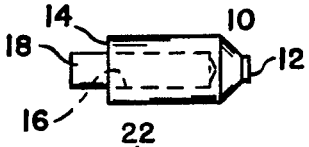
FIG. 4 is a view of the blank of FIG. 3 with a copper core inserted into the cup defined by the indentation.
Figure 5:
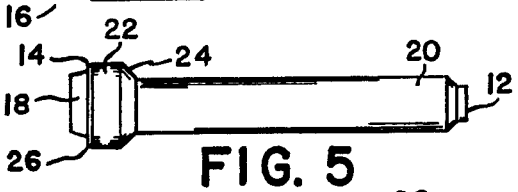
FIG. 5 is a view of the blank of FIG. 4 which has been extruded to a final desired length to define a center wire.
Figure 6:
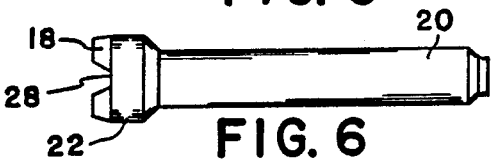
FIG. 6 is a view of the center wire of FIG. 5 with cross slot formed in the copper core center.

After the wire 10 is cut into a blank as shown in FIG. 1 and lubricated, it is taken to a first die where the first 12 and second 14 ends are squared to define flat surfaces and end 12 is extruded to produce a tip while an indentation 15 is formed in end 14 as shown in FIG. 2. The cylindrical blank 10 is transported to a second die and further extruded to develop a center bore 16 that extends from indentation 15, as shown in FIG. 3. After a copper core 18 is inserted in bore 16, as shown in FIG. 4, the cylindrical blank 10 is transported to a third die and further extruded to a predetermined length as shown in FIG. 5 to produce a center wire 20. Center wire 20 has a shoulder 22 with a tapered surface 24 and a lip 26.

The center wire 20 is removed from the third die and carried to a station where cross 28 is formed into the copper core 18 to complete its manufacture. A center wire 20 manufactured according to the procedure set forth above could be inserted into the porcelain or ceramic body 30 of a prior art spark plug 32 of a type shown in FIG. 13. This type center wire 20 would adequately perform under most operating conditions and meet the life requirements for current automobiles.

Figure 7:
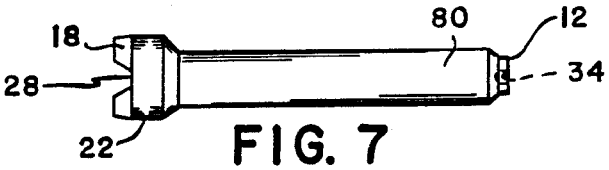
FIG. 7 is a view of the center wire of FIG. 6 having an axial cylindrical hole located in the tip on the first end.
Figure 8:
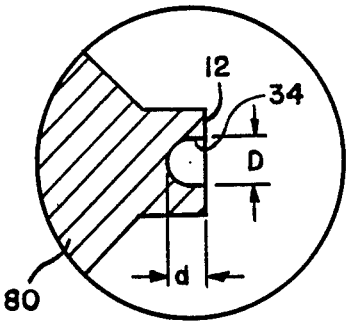
FIG. 8 is an enlarged sectional view of the tip on the first end of the center wire in FIG. 7.

The center wire 20 is further developed according to the disclosure of this invention by being transported to a fourth die where an axial cylindrical bore or hole 34 is placed in the tip on the first end 12, to produce a center wire 80 as shown in FIGS. 7 and 8. The depth "d" of the hole 34 can equal the diameter "D" but in most instances will be somewhat less and a depth "d" of about three fourth "D" has been satisfactory for this invention.

Figure 9:
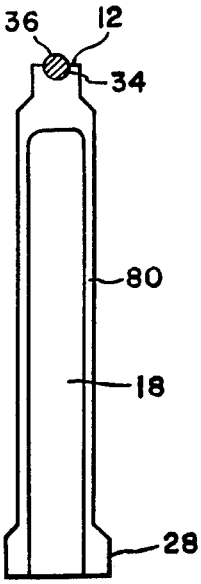
FIG. 9 is a view of the center wire of FIG, 7 with a sphere of platinum located in the axial hole in the tip.

A sphere 36 of platinum having a diameter equal to the diameter "D" of the hole 34 is paced in first end 12 as shown in FIG. 9. Since sphere 36 has the same physical dimension "D" as hole 34, friction engagement occurs. Due to the cost of platinum under normal circumstances a sphere diameter of about 0.030 inches or 0.076 cm is sufficient to establish the desired protection for the first end 12.

Figure 10:
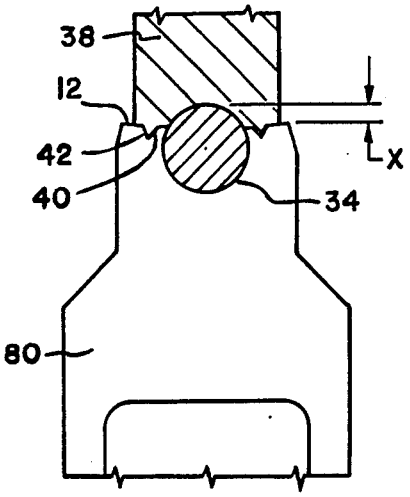
FIG. 10 is a sectional view illustrating the engagement of a punch with the tip on the first end to create an annular lip which engages and retains the sphere of platinum in the axial hole.

Once the sphere 36 is placed in hole 34, center wire 20 is transported to a station illustrated in FIG. 10 where a die 38 is brought into engagement with the tip on end 12 to produce an annular lip 40. Lip 40 engages and surrounds the platinum sphere 36 in hole 34. As seen in FIG. 10, a portion of the sphere 36 having a height "x" extends above the first end 12 while a groove 42 is produced in the first end 12. Groove 42 is such that a staking angle of approximately 45 is produced in the annular lip 40.

Figure 11:
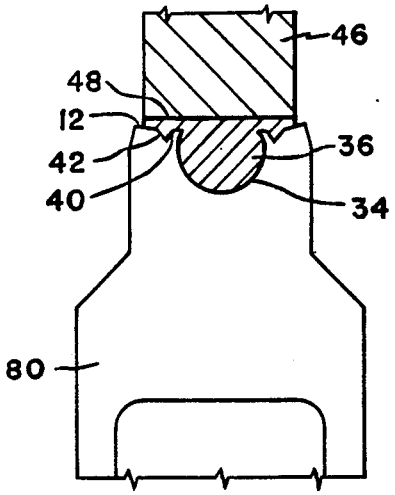
FIG. 11 is a sectional view illustrating the engagement of a punch which flattens a portion of the sphere to produce a disc shaped protective surface on the tip.

Under some circumstances the manufacture of the center electrode 20 could terminate with this staking as the find step. However, to create a larger area of protection on the first end 12, the center electrode 20 is carried to a station shown in FIG. 11 where die 46 engages that portion of the sphere 36 extending above the first end 12 and flattens the same to produce a disc 48. Disc 48 has diameter that is at least equal to the diameter of the hole 34 and for most application covers at least one half of the tip surface on the first end 12. As seen in FIG. 11, the disc 48 extends over groove 42 to provide protection of the annular lip 40.

Figure 12:
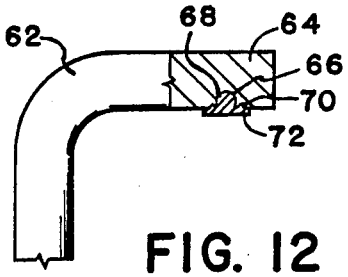
FIG. 12 is an illustration of a side wire electrode having a sphere of platinum located therein by a staking operation similar to the center wire electrode of FIG. 11.
Figure 13:
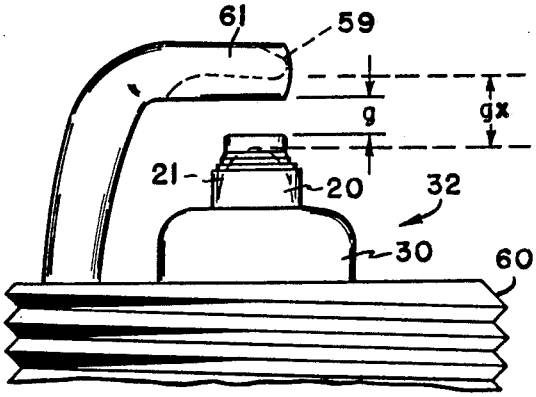
PRIOR ART FIG. 13
FIG. 13 is an enlarged view of a prior art spark plug showing the relationship between a side and center wire electrodes.

A standard side wire 61 shown in FIG. 13, is modified to produce side wire 62 shown in FIG. 12. Side wire 62 has a base member 64 with a hole or bore 66 located therein and a sphere 68 of platinum retained therein by an annular lip 70 which is placed therein by a punch in a staking operation. Disc 72 formed by flattening a portion of sphere 68 covers and protects the annular lip 70 from exposure to combustion gases in an engine.

Figure 14:
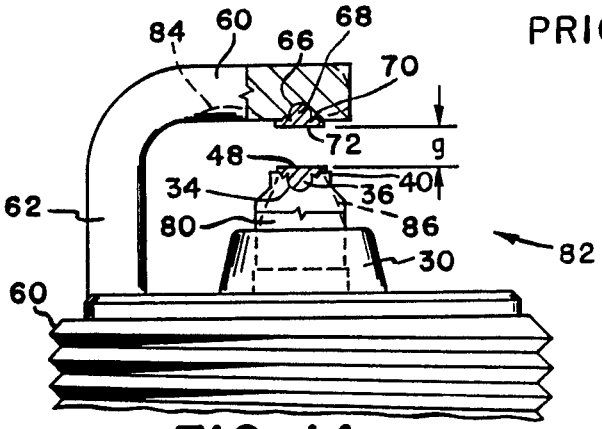
FIG. 14 is an enlarged view of a spark plug showing the relationship between the side and center wire electrodes made according to the principals of this invention.

Center electrode 80 and side wire 62 are placed in a standard spark plug 32 as shown in FIG. 14 to produce spark plug 82. The gap "g" between the surfaces of disc 48 and 72 of spark plug 82 is set identical with gap "g" in spark plug 32.

In order to evaluate the spark plug 82 made according to this invention, it and a standard spark plug 32 as illustrated in FIG. 13 were subjected to 750 hours of operation to simulate the operation of a vehicle. At the end of the test, the engine simulated gases and spark plug operation had eroded side wire 61 in the standard spark plug 32 in FIG. 13 to a depth illustrated by dashed line 59 and the center electrode 20 illustrated by dashed line 21. As clearly illustrated the spark gap "g" has grown to "gx". Under most conditions it would be accurate to state that a spark plug gap of "gx" could result in the operation of the engine which would not meet desired specifications.

While the side electrode 62 and center electrode 80 had eroded as illustrated by dashed lines 84 and 86, respectively, the gap "g" between the surfaces 48 and 72 of the platinum spheres 34 and 68 did not change as a result, engine performance equipped with spark plug 82 could operate for an extended period of time without any change.

I claim:

1. A method of manufacturing electrodes for a spark plug comprising the steps of:

cutting a piece of inconel wire from a source to define a cylindrical blank having a first end and a second end;

placing said cylindrical blank in a first die, said first die forming an extruded tip on said first end;

placing said cylindrical blank in a second die, said second die forming an extruded cup in said cylindrical blank that extend from said second end toward said first end;

inserting a copper core in said cup;

placing said cylindrical blank and copper core in a third die to extrude to a predetermined length between said first end and said second end for a resulting center wire;

carrying said center wire to a bath where at least said first end is cleaned to remove oil or grease that may have been accumulated thereon as a result of the extrusion of said cylindrical blank;

transporting said center wire in a station where a cylindrical hole is placed in said first end;

inserting a platinum sphere in said hole; and striking said first end with a punch to produce an annular lip on said first end which engages and mechanically retains said platinum sphere in said hole.

2. The method as recited in claim 1, further including the step of:

flattening first end to produce a uniform tip for said center electrode.

3. The method as recited in claim 2 wherein the depth of said hole in said first end and the diameter of said sphere of platinum are substantially equal.

4. The method as recited in claim 3, wherein said punch has a staking angle of approximately 45° to produce said annular lip.

5. The method as recited in claim 4, wherein the depth of said hole in said first end is approximately equal to the three-fourth diameter of said sphere of platinum, said striking of said first end with a punch causing said annular lip to engage said sphere while at the same time a portion of said sphere extends above said first end.

6. The method as recited in claim 5, further including the step of;

striking said sphere with a punch causing said portion above said first end to flow around said annular lip and create a substantially flat surface on said first end.

7. The method as recited in claim 6, wherein the flat portion of sphere forms as disc surface which covers at least one-half of the tip of said first end.

* * * * *